United States Patent [19]

Staley

[11] 3,977,643

[45] Aug. 31, 1976

[54] SUPPORT MEANS FOR A HOOK MEMBER OR THE LIKE

[76] Inventor: David R. Staley, Rte. 4, Box 702, Eugene, Oreg. 97405

[22] Filed: May 7, 1975

[21] Appl. No.: 571,712

[52] U.S. Cl. ..... 248/339; 248/217

[51] Int. Cl.[2] ..... B42F 13/00

[58] Field of Search ..... 248/339, 342, 343, 217, 248/219, 220, 227, 304, 220.5; 24/68 R, 68 A, 71 CT, 71 T, 249 SH, 90 W, 153 S; 85/3 K

[56] References Cited

UNITED STATES PATENTS

| | | | |
|---|---|---|---|
| 241,991 | 5/1881 | Jones | 248/220.5 |
| 500,956 | 7/1893 | Schraudner | 248/304 |
| 860,636 | 7/1907 | Church | 151/41.7 |
| 1,051,893 | 2/1913 | Joseph | 248/304 |
| 1,603,003 | 10/1926 | Ennis | 248/220.5 |
| 2,916,235 | 12/1959 | Nagel | 248/217 |

FOREIGN PATENTS OR APPLICATIONS

| | | | |
|---|---|---|---|
| 483,279 | 7/1953 | Italy | 85/3 K |

*Primary Examiner*—Robert A. Hafer
*Attorney, Agent, or Firm*—James D. Givnan, Jr.

[57] ABSTRACT

Support means for placement on a ceiling or wall structure for the support of ornamental or functional items. The support means includes a load supporting attachment for abutment with a flat surface which attachment is held in place by a flexible wire of small diameter which extends through a ceiling or wall opening also of reduced diameter. The wire is removably secured in place by a locking plate which is frictionally engageable with a load bearing member in place on the unseen side of the ceiling or wall structure. Means are provided interengaging the locking plate and the load bearing member to retain said plate against undesired movement after installation.

9 Claims, 5 Drawing Figures

SUPPORT MEANS FOR A HOOK MEMBER OR THE LIKE

BACKGROUND OF THE INVENTION

The present invention relates generally to support means for ceiling and wall attachments.

Known in the prior art are various types of mechanical devices for transferring loads to ceiling components such as wallboard which, by nature, require that loading be over a surface area. Included in such known arrangements are threaded "blind" fasteners having expandable components deformable, upon tightening of the fastener from the room side, to engage the inner surface of the ceiling. Another such device is that including spring biased components insertable in a collapsed state through a ceiling opening which thereafter automatically open for ceiling abutment. These as well as other anchoring devices require the drilling of an opening normally a quarter of an inch or so in diameter. A problem results when the ceiling supported article has to be relocated or removed. The sizeable hole exposed detracts from ceiling appearance and requires patching to return the ceiling to original appearance. The problem is particularly apparent in rental property wherein tenants when vacating a premises simply detach the ceiling supported fixture leaving the unsightly opening.

SUMMARY OF THE INVENTION

The present invention is embodied within support means for various types of wall attachments wherein a small diameter wire is inserted through a ceiling for locked engagement with load bearing means in place on the upper side of the ceiling. A locking component serves initially to tension the wire member and thence lock same so as to transmit wire loads to the load bearing member. Installation, with the exception of the formation of a small diameter ceiling opening, is accomplished without the aid of tools as is removal of the support means.

Important objects of the present support means include: support means requiring only a small diameter ceiling opening thus obviating patching of the opening upon removal of the ceiling attachment as said opening is of a size unnoticed by a casual observer; the provision of support means capable of supporting heavy loads by reason of load dispersal over a large area yet capable of being installed and removed without the benefit of tools other than hole forming means such as a drill; the provision of support means utilizing a small diameter wire of high tensile strength in distinction to known fasteners requiring passage of a threaded member through the ceiling; the provision of support means including a locking member which also serves to tension the wire member during installation to assure the ceiling attachment is in firm abutting engagement with the ceiling surface; the provision of a support means wherein a locking member is frictionally engaged with a retainer clip in direct proportion to the load borne; the provision of support means highly suitable for supporting swag lights, hanging baskets and ornamental objects.

DESCRIPTION OF THE PREFERRED EMBODIMENT

Figure 1:
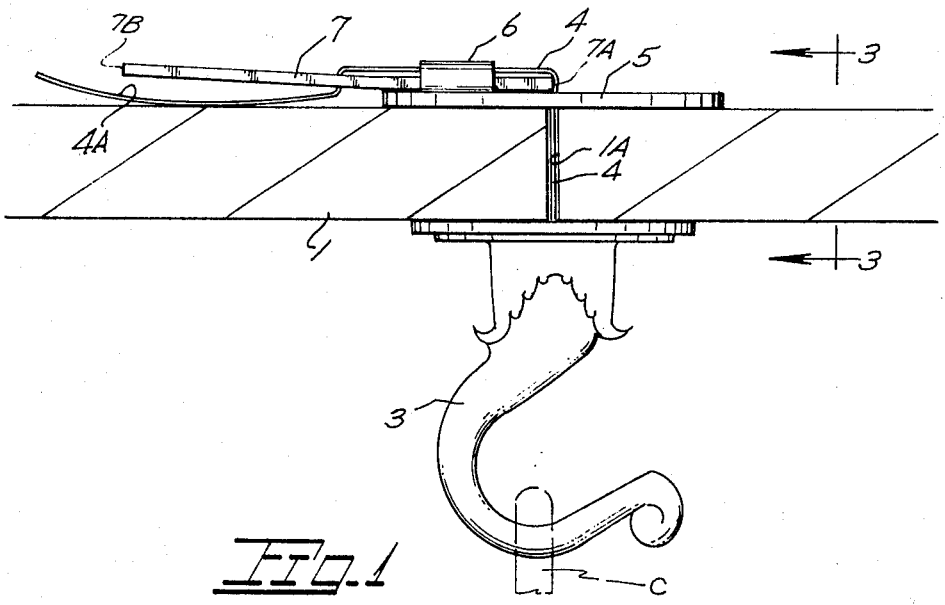
FIG. 1 is a side elevational view of the support means with a ceiling structure shown in section.

With continuing reference to the accompanying drawing wherein applied reference numerals indicate parts similarly identified in the following specification, the reference numeral 1 indicates a ceiling structure to which the present support means is removably attached. While a ceiling is specifically referred to it is to be understood that reference numeral 1 could indicate an upright wall member in those instances where access may be had to the interior or backside of the wall member. A ceiling opening at 1A is in the form of a small diameter bore of a diameter corresponding approximately to the diameter of a wire later described.

Figure 3:
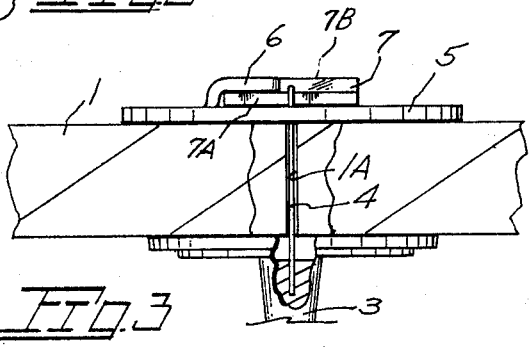
FIG. 3 is a view taken along line 3—3 of FIG. 1.

Indicated at 3 is a hook structure which is intended to be attached to ceiling 1 in a secure manner and intended for supporting loads such as those imparted by a chain link C associated with hanging fixtures such as swag lights, hanging baskets for plants, objects of art, etc.,. While shown in the nature of a hook it will be obvious that attachment 3 may take a wide diversity of form and function from supporting decorative objects to purely functional objects. Shown integral with support member 3 is a steel wire 4, preferably of stainless steel, which may be cast in place in ceiling attachment 3 (FIG. 3) or otherwise suitably secured. Wire segment 4, in one embodiment of the invention, is of stainless steel approximately .024 of an inch in diameter having a tensile rating well over one hundred pounds. Obviously the tensile strength of wire 4 (as well as other components of the present support means) will be suited to the load supporting task at hand. A terminal length of wire is indicated at 4A.

In load transmitting, surfacial engagement with the upper surface of ceiling 1 is a load bearing member 5 apertured at 5A. Coupling means is shown in the form of a clip 6 which, for reasons of economic manufacture, may be punched from member 5 or cast integrally therewith if the latter is of cast construction. For retained engagement with said clip is a locking plate 7 having inner and outer ends 7A and 7B. Said plate is apertured at 8 for passage of wire 4 with that segment of the wire passing below the plate (as viewed in FIG. 1) exerting an upward biasing action on the rearward portion of the plate. Plate 7 is preferably of material such as a high impact or glass reinforced plastic. Inner edge 7A will yield somewhat to the wire 4 tensioned thereover so as to prevent fracturing or weakening of the wire. It is desirable that the wire seat or form a slight indentation where it passes over edge 7A to prevent subsequent lateral shifting of the plate and wire once installed in place.

Figure 2:
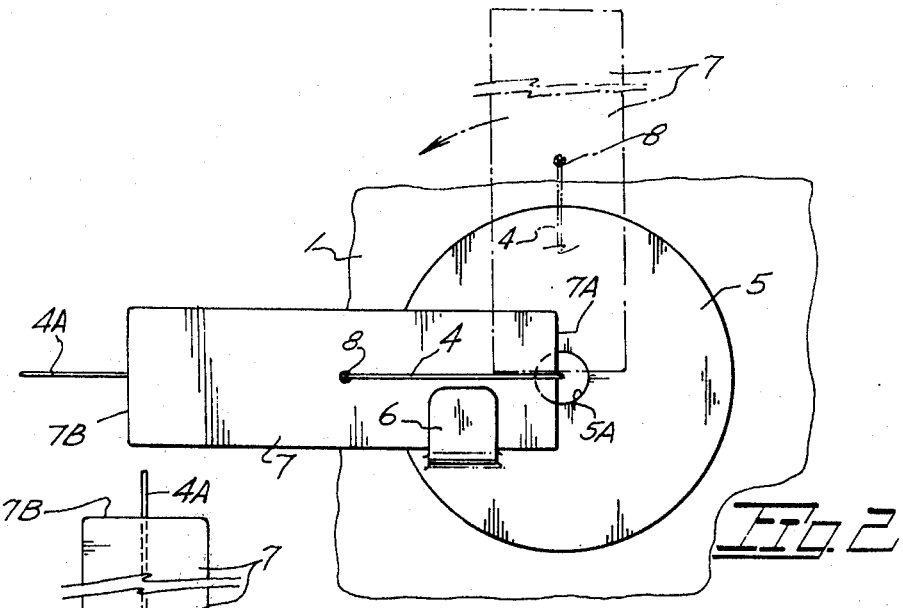
FIG. 2 is a plan view of FIG. 1.
Figure 4:
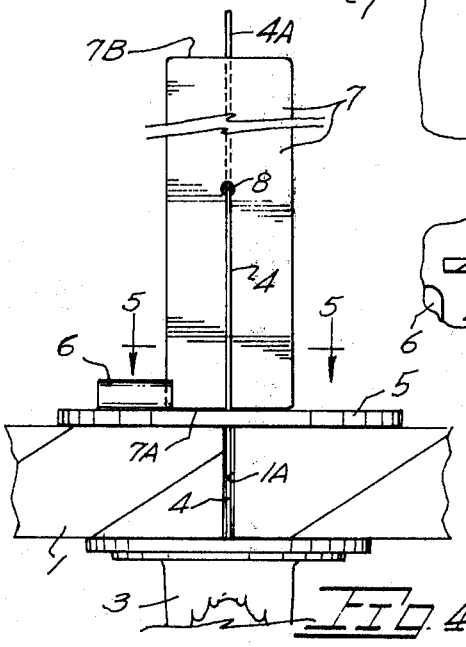
FIG. 4 is a side elevational view showing the locking member during installation.
Figure 5:
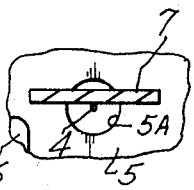
FIG. 5 is a sectional view taken downwardly along line 5—5 of FIG. 4.

In use, the present support means requires the forming of a small diameter opening in ceiling 1 such as by drilling or in some instances a nail hole will suffice. Wire 4 is threaded through the opening and for purposes of temporary retention of the wire and attachment 3, the wire may be gently curved before insertion. With attachment 3 temporarily in place, load bearing member 5 is passed onto the wire and disposed in place on the ceiling about ceiling opening 1A. Wire 4 is threaded through opening 8 in plate 7 whereupon plate 7 is rotated to the vertical with its edge 7A extending diametrically across opening 5A in member 5. Plate 7 is thence swung downwardly to the broken line position of FIG. 2 and in so doing results in edge 7A tensioning wire 4 causing snug abutment of attachment 3 with the ceiling surface. Thereafter, plate 7 is swung to the FIG. 2 solid line position (per applied arrow) to complete the attachment. Clip 6 retains the plate 7 against upward or later displacement as said plate is biased upwardly into clip engagement by reason of the inherent flexible nature of wire 4. Accordingly, the attachment means is securely attached to the ceiling with components of the support means in biased engagement with one another to prevent loosening over long periods of use. Removal of the present support means is believed obvious from the foregoing.

While I have shown but one embodiment of the invention it will be apparent to those skilled in the art that the invention may be embodied still otherwise without departing from the spirit and scope of the invention.

Having thus described the invention what is desired to be secured under a Letters Patent is:

1. Support means for a ceiling attachment, said support means comprising in combination, a ceiling attachment for supporting a load, a segment of flexible wire secured to said attachment and adapted for inserted passage through a ceiling opening of a size corresponding to the wire diameter, a load bearing plate member in place on the opposite side of the ceiling from said ceiling attachment, a wire locking plate defining an opening thru which extends a portion of said flexible wire segment, and means removably coupling the wire locking plate on said load bearing plate member to retain said locking plate and said wire in place against loads imparted to the ceiling attachment.

2. The support means claimed in claim 1 wherein said ceiling attachment is of hook configuration.

3. The support means claimed in claim 1 wherein said wire segment is integral at one of its ends with said ceiling attachment.

4. The support means claimed in claim 1 wherein said load bearing plate member is centrally apertured to receive said wire segment.

5. The support means claimed in claim 1 wherein, upon installation, a length of wire segment overlies a portion of the locking plate.

6. The support means claimed in claim 5 wherein said locking plate serves to tension the wire segment when moved from an upright wire receiving position through approximately ninety degrees into surfacial engagement with the load bearing plate member.

7. The support means claimed in claim 5 wherein a remaining terminal length of the wire segment extends outwardly from the locking plate opening for biased contact with the ceiling surface to thereby exert a resultant biasing action against the locking plate to firmly engage same with the coupling means to prevent locking plate shifting after installation.

8. The support means claimed in claim 7 wherein said locking plate is of a material softer than said wire segment to prevent wire fracturing.

9. The support means claimed in claim 1 wherein said coupling means comprises a clip integral with said load bearing plate member.

* * * * *